United States Patent [19]

Chan

[11] 4,039,105

[45] Aug. 2, 1977

[54] FERTILIZER DISPENSER

[76] Inventor: See Fong Chan, 47-09 Newtown Road, Astoria, N.Y. 11103

[21] Appl. No.: 651,638

[22] Filed: Jan. 23, 1976

[51] Int. Cl.[2] ..... B05B 7/30

[52] U.S. Cl. ..... 222/193; 239/317; 239/318; 239/341

[58] Field of Search ..... 23/267 B; 137/268; 239/310, 311, 317, 318, 341; 222/193

[56] References Cited

U.S. PATENT DOCUMENTS

| | | | |
|---|---|---|---|
| 846,100 | 3/1907 | Estep | 137/268 UX |
| 955,418 | 4/1910 | Mikovey | 239/314 |
| 2,711,928 | 6/1955 | Randa | 137/268 X |
| 2,989,979 | 6/1961 | Karlson | 137/268 |
| 3,185,170 | 5/1965 | Westman | 137/268 |
| 3,690,563 | 9/1972 | Farrington et al. | 239/341 X |
| 3,776,274 | 12/1973 | Riley | 137/268 X |

*Primary Examiner*—Robert B. Reeves
*Assistant Examiner*—David A. Scherbel

[57] ABSTRACT

A fertilizer dispenser associated with an ordinary garden hose, the dispenser being adapted to introduce under suitable conditions other materials such as fertilizers, soap powders and fire extinguishing chemicals. The desideratum is a uniform mixture of water and material and that objective has been found attainable by causing the two components to be mixed as a consequence of providing a uniquely effective system for effecting such mixture by critically locating the outlet ends of connecting tubing with respect to the wall structures of the fertilizer container and the liquid flow line.

1 Claim, 2 Drawing Figures

FERTILIZER DISPENSER

The invention relates to dispensers and, in particular, devices employed to effect mixtures of liquids and solids, such mixtures being formed on account of the flow of the liquid through strictly confined areas located in proximity to the container for the solids.

In general, the present invention contemplates a pipe or conduit, such as an ordinary garden hose, and a specially constructed system of flow through devices including tubes and containers for storing and ejecting solids such as fertilizers, soap powders or fire extinguishing materials into the liquid flow conduit. The inlet and outlet tubes connecting the conduits and containers are actually arranged with respect to the location of their openings within both members, so as to effect an improvement in the mixing and dispensing function over the system disclosed, for example, in U.S. Pat. No. 3,165,114. The purpose of such arrangement is to create automatically as a consequence of the liquid flow the desired high and low pressures necessary to effect the two directional flow of liquid into the solid material container and the exiting of the solid and liquid mixture therefrom.

One object of the invention is to provide an improved system for producing a solid and liquid mixture without interfering with the liquid flow therethrough in terms of its velocity and the pressure necessary for its intended purpose.

Figure 1:
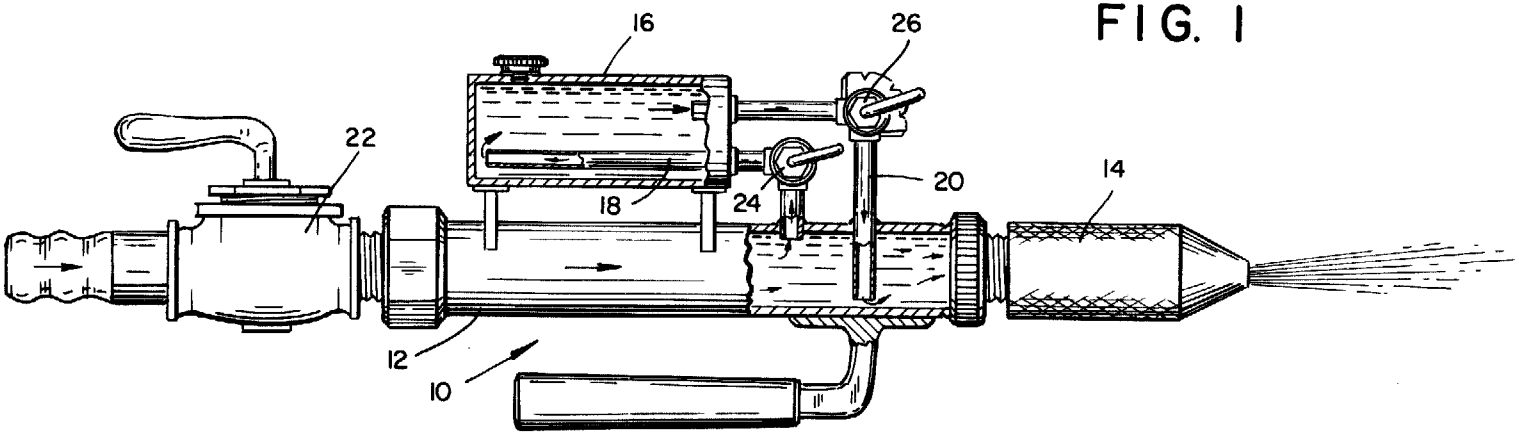
Figure 2:
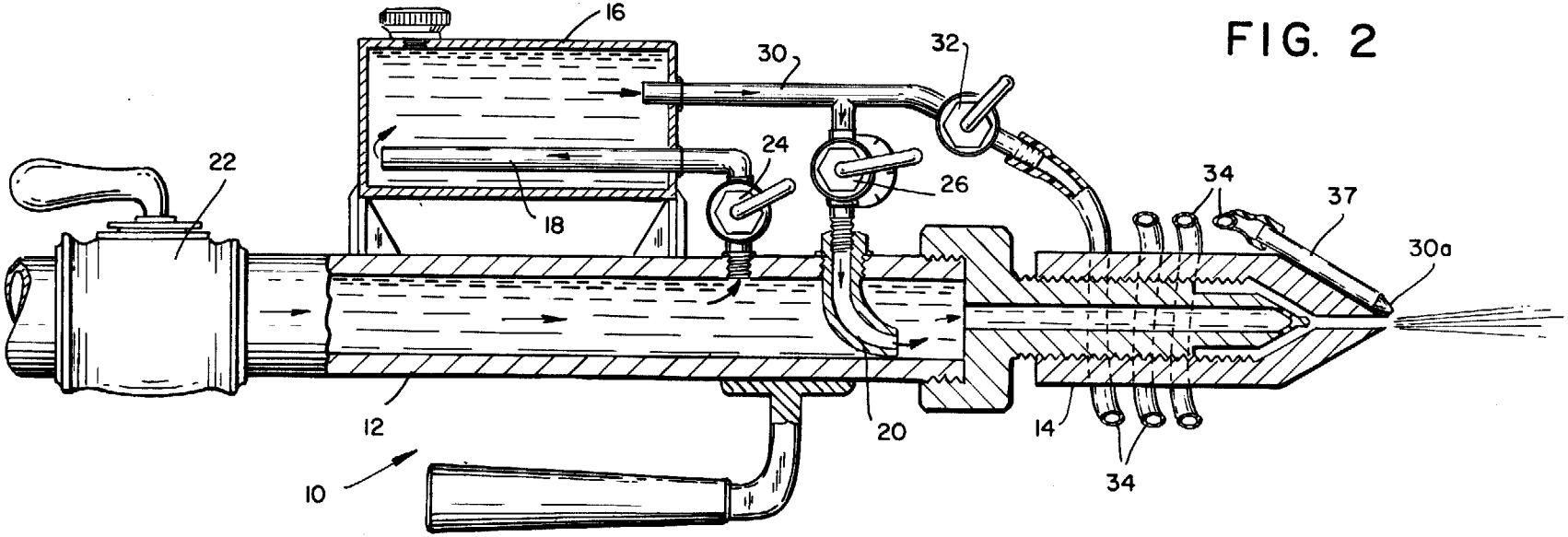

Other objects and advantages of the invention may be appreciated on reading the following description of two of its embodiments which is taken together with the accompanying drawings, in which:

FIG. 1 is an elevation view in partial section showing one embodiment of the invention; and FIG. 2 is an elevation in section illustrating another embodiment of the invention.

Referring to FIG. 1 of the drawings flow conduit 10 comprises cylindrical channel member 12 and nozzle 14 threadably attached to one end thereof. Solid material holder 16 is in communication with the member 12 by means of inlet tube 18 and outlet tube 20. The outlet end of the outlet tube 20 extends considerably farther into the member 12 than does inlet tube 18. Similarly, the inlet tube 18 extends considerably farther into the solid holder 16 than does the outlet tube 20. After the water starts to flow in conduit 10, this arrangement combines to cause a substantially higher pressure at the opening of tube 18 than that at the opening of the tube 20 with the member 12. It has been found that the pressure ratio is approximately 3 to 1 for ¼ inch tubing. After the holder 16 is filled with water, the relative high pressure in tube

18 will force the mixture to flow through the tube 20. The length of the tube 18 within the holder relative to the length of the tube 20 within the holder enhances circulation of the liquids directing the flow from the opening in tube 18 to the opening of the tube 20. The relative pressures at the tube openings create the desired flow into and out of the holder so that the liquid and solid mixture in the tube 20 is effectively passed back into the line and finally out of the system through the nozzle 14.

Control valves 22, 24 and 26 are provided in the conduit 10 and the inlet and outlet tubes 18 and 20, respectively. Their purpose is to control the incoming liquid flow and the relative amount of liquid and solid mixture desired or close the mixture off completely.

In addition, as shown in FIG. 2, tube 30 having an outlet end **30*a* immediately in front of the nozzle outlet and communicating with the holder 16 is useable to effect the desired mixture when control valve 26 is shut down. It is to be noted that the inlet opening of the tube 30** scarcely projects beyond the wall of the holder through which it extends thus creating a specially high pressure tube end relative to its nozzle end.

In addition, as shown in FIG. 2, the tube 30 has an outlet end **30*a* immediately ahead of the nozzle outlet and has provided therein a control valve 32. Also provided in the tube 30 between the valve 32 and the outlet end 30'a is an expansion coil 34 and communicating nozzle 37, the coil 34 being wound on the control nozzle 14 and held thereon by the nozzle 37 while the control nozzle 14** is being adjusted in the conventional manner.

Various modifications of the invention may be effected by persons skilled in the art without departing from the principle and scope thereof as defined in the appended claims.

What is claimed is:

1. A liquid-solid mixture dispenser system comprising a flow line having an outlet end and adjustment control means thereof, a container for storing material, an inflow tube and an outflow connecting said flow line and said container, said inflow tube extending substantially farther into said container than said outflow tube, said outflow tube extending substantially farther into said flow line than said inflow tube, a second outflow tube being in communication with said container having an end opening juxtaposed to the outlet end of said flow line, said second outflow tube including an expansion coil mounted on said flow line near the outlet end thereof, whereby said expansion coil permits said second outflow tube and the outlet end of said flow line to remain in position during the control adjustment at the outlet end of the flow line.

* * * * *